US005088527A

United States Patent [19]

Monnig

[11] Patent Number: 5,088,527

[45] Date of Patent: Feb. 18, 1992

[54] CHOKE VALVE FOR BOTTLE FILLING DEVICE

[75] Inventor: Len W. Monnig, Moncks Corner, S.C.

[73] Assignee: Figgie International, Inc., Willoughby, Ohio

[21] Appl. No.: 612,626

[22] Filed: Nov. 14, 1990

[51] Int. Cl.[5] ..... B65B 31/00

[52] U.S. Cl. ..... 141/39; 141/40; 141/46; 141/301; 141/392

[58] Field of Search ..... 141/31, 39, 40, 46, 141/301, 392

[56] References Cited

U.S. PATENT DOCUMENTS 2,896,675 7/1959 Voelker ..... 141/39
3,757,835 9/1973 Copping ..... 141/286
3,967,813 11/1990 Ponvianne et al. ..... 141/128
4,589,453 5/1986 Weiss ..... 141/39
4,688,608 8/1987 Puskarz et al. ..... 141/39

*Primary Examiner*—Ernest G. Cusick
*Attorney, Agent, or Firm*—Renner, Kenner, Greive, Bobak, Taylor & Weber

[57] ABSTRACT

A bottle filling apparatus is provided in which a non-contact choke valve is employed. The choke valve comprises a disc having an outer cylindrical wall which is received within a valve seat having an inner cylindrical wall. The cylindrical walls have a close tolerance fit, preventing flow therebetween by molecular action and surface tension. Additionally, the bottom surface of the seal and the top surface of the seat have similar tapers such that, with the seat below the seal in a normal dispensing operation, beverage flow is directed into the bottle without turbulence and the resultant foaming action.

15 Claims, 2 Drawing Sheets

CHOKE VALVE FOR BOTTLE FILLING DEVICE

TECHNICAL FIELD

The invention herein resides in the art of bottle filling devices for use with counter pressure bottle filling machines. More particularly, the invention relates to a choke valve for a filling head as employed in such machines. Specifically, the choke valve is of the non-contacting type.

BACKGROUND ART

It has previously been well known to employ counter pressure bottle filling machines for purposes of filling bottles or other containers with liquids such as beverages and the like. The structure of such filling machines, including the multiple filling heads typically employed therewith, are well known and documented such as in U.S. Pat. Nos. 3,757,835 and 4,688,608, assigned to the assignee of the instant application. The invention herein relates to bottle filling machines of the nature known from these prior art references, differing primarily in the construction and operation of the choke valve assembly.

It is well known that bottle filling machines typically include a reservoir of beverage or liquid having a pressure head maintained thereabove. The bottle filling machine typically has a plurality of identical bottle filling heads circumferentially spaced about the reservoir. Each bottle filling head has a resilient seal receiving and sealing the mouth of a bottle. A counter pressure tube extends into the bottle at one end thereof, and into the pressure head at the other. The tube has openings or orifices at each of the ends, the same being selectively sealed during the operation of the bottle filling machine.

Each of the bottle filling heads employs several valve systems controlling physical movement and/or opening and closing of the passage of the counter pressure tube. As will be appreciated from reference to prior U.S. Pat. No. 3,757,835, when a bottle is received by the resilient seal, a valve at the top of the counter pressure tube allows the pressure head above the reservoir to communicate with the interior of the bottle. The resulting pressure in the bottle opens a liquid valve assembly fixed to the bottom of the counter pressure tube. This liquid valve consists of a disc fixed to the counter pressure tube and having a tapered edge adapted to reciprocatingly engage with and separate from a fixed valve seat maintained adjacent the sealing member.

A choke valve is also maintained about the counter pressure tube and is opened by the pressure of the beverage and the flow of the beverage thereacross upon opening of the liquid valve. When the beverage in the bottle reaches the level of an aperture or apertures in the end of the counter pressure tube, the flow of the beverage stops, for backflow of the counter pressure gas through the counter pressure tube is prevented.

Immediately upon cessation of beverage flow, the choke valve closes by spring actuation. An inner tapered surface of the choke valve sealingly engages a portion of the tapered edge of the disc of the liquid valve. The closure is attained by overlapping engagement of the parallel tapers of the choke valve and the disc of the liquid valve. This closure immediately prevents any further flow of beverage into the bottle for release of gas from the bottle. Immediately thereafter, conventional control of a lever arm moves the counter pressure tube downwardly, causing the disc of the fluid valve to close against its seat, allowing the bottle to be removed, capped, and cased.

While the prior art discussed above has been generally successful in filling bottles and other containers, certain problems are inherent with its structure and operation. Particular problems have been observed with respect to the choke valve used in such filling heads. The seal of the choke valve has been found to be given to sticking due to the overlapping mating engagement of the tapered surfaces of the choke valve and the liquid valve disc. Such sticking results in delays in operating time, reducing the efficiency of operation of the filling machine. Further, the prior choke valve has been given to the generation of turbulence during flow and upon the closure thereof. This turbulence is the result of path restrictions between the valve members when the valve is opened, as well as the abrupt positive action of closure of the valve upon actuation. Such turbulence generates foam in carbonated beverages, a most undesirable occurrence.

DISCLOSURE OF INVENTION

In light of the foregoing, it is a first aspect of the invention to provide a filling head for a bottle filling machine in which the choke valve is absent a contacting seal.

Another aspect of the invention is to provide a filling head for a bottle filling machine in which the choke valve is not given to sticking.

Still a further aspect of the invention is the provision of a filling head for a bottle filling machine in which the choke valve is not given to the generation of turbulence in beverage flow.

An additional aspect of the invention is the provision of a filling head for a bottle filling machine in which flow control by a choke valve is achieved by surface tension or molecular attraction of the beverage at a restriction provided by the closed valve.

Yet an additional aspect of the invention is the provision of a filling head for a bottle filling machine in which the choke valve is reliable and durable in operation, while being easy to construct and maintain with state of the art materials and techniques.

The foregoing and other aspects of the invention which will become apparent as the detailed description proceeds are achieved by a bottle filling apparatus, comprising: a filling tank for receiving liquid therein beneath a pressure head of gas; a seal in a base portion of said tank for sealingly securing a mouth of a bottle; a vent tube extending from said pressure head within said tank at a first end thereof to the interior of said bottle at a second end thereof, said tube having respective first and second apertures at said first and second ends; a sleeve receiving said tube, said sleeve receiving liquid from said filling tank and serving as a conduit for passing said liquid from said tank to said bottle; and a choke valve interposed between said sleeve and said bottle for selectively inhibiting and enabling said passing of liquid, said choke valve comprising an inner ring received within an outer ring, said inner and outer rings being out of contact with each other both when said valve is open and when said valve is closed.

Other aspects of the invention are attained by a bottle filling apparatus having a tank for receiving liquid therein beneath a pressure head of gas, a seal in a base portion of the tank for receiving a mouth of a bottle, a tube within the tank extending from the pressure head at one end to the bottle at the other end, the tube having openings at each of the two ends, and a sleeve receiving the tube and serving as a conduit for passing liquid from the tank to the bottle, such bottle filling apparatus including the improvement of a choke valve, comprising: a disc fixedly received upon said tube and concentric with said tube; and a cylindrical seat received upon and concentric with said tube, said seat adapted to receive said disc within said seat.

DESCRIPTION OF DRAWINGS

For a complete understanding of the objects, techniques, and structure of the invention, reference should be made to the following detailed description and accompanying drawings wherein.

BEST MODE FOR CARRYING OUT THE INVENTION

Figure 1:
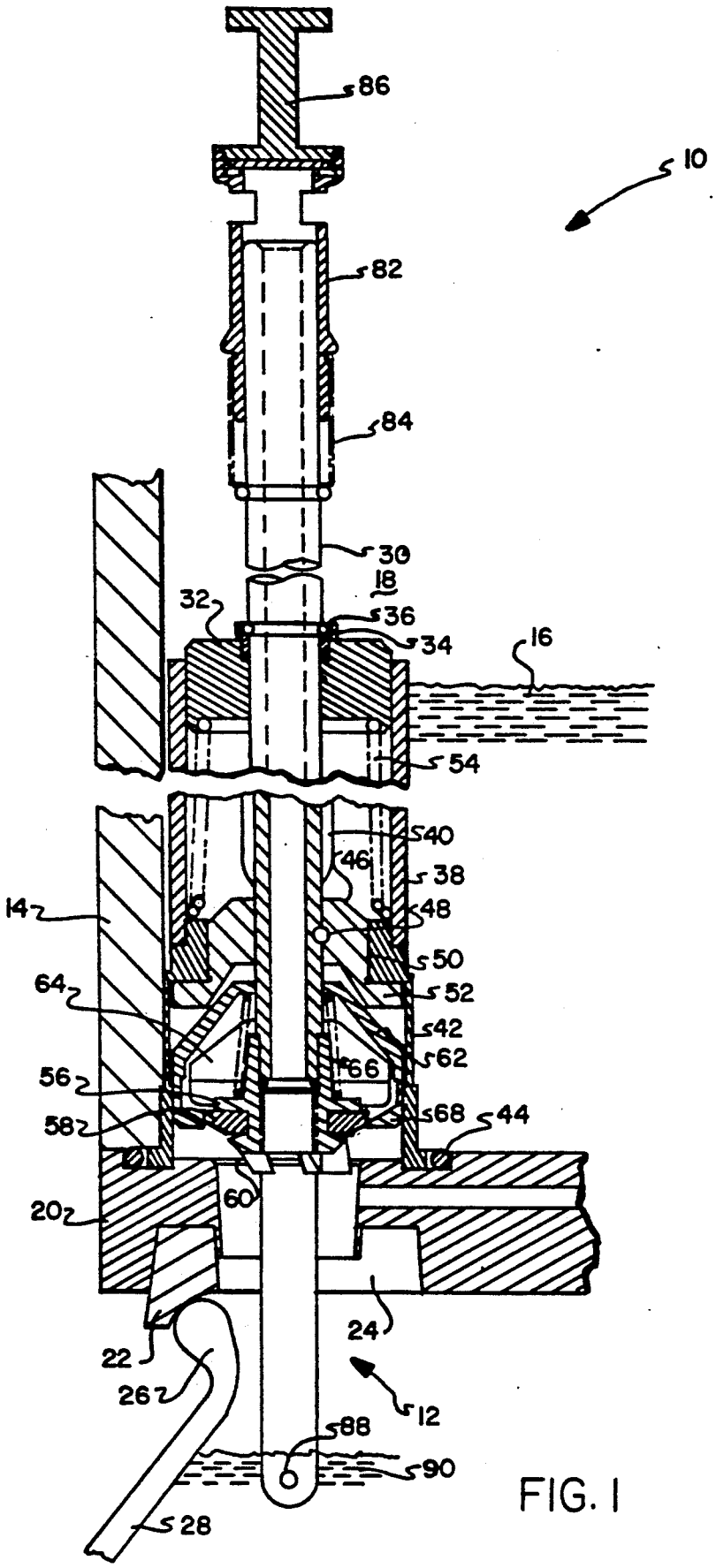
FIG. 1 is a partial sectional view of one filling head of a filling machine according to the invention, showing the choke valve thereof.

Referring now to the drawing and more particularly FIG. 1, it can be seen that a bottle filling device according to the invention is designated generally by the numeral 10. The device 10 comprises a plurality of filling heads 12 uniformly spaced about the perimeter of a filling tank 14. For purposes of illustration, only a single filling head 12 has been shown in the drawing. The interior of the tank 14 is substantially filled with a beverage 16 or other liquid to be dispensed, and with a pressure head of gas 18 maintained thereabove. While various types of gas may be employed for the dispensing operation, in the dispensing of soft drinks and the like it has been found that carbon dioxide gas is most suitable as the driving force.

A snift block 20 is provided as the bottom or base portion of the filling tank 14 and includes a snift valve for association with each of the filling heads 12 to vent the same to atmosphere in a manner well known to those skilled in the art, and a description of which is unnecessary for an appreciation of the invention herein. A resilient seal 22, of rubber or other suitable material, is received by a bore 24 within the snift block 20 in association with each of the filling heads 12. As shown, the mouth or rim 26 of a bottle 28 is brought into sealing engagement with the resilient seal 22 to commence the dispensing operation.

A counter pressure tube or vent tube 30 passes from the pressure head 18 into the bottle 28, having openings at such ends for providing controlled communication between the pressure head 18 and the interior of the bottle 28. An end plug 32 is attached to the vent tube 30 by means of the collar 34 and O-ring 36. Accordingly, the vent tube 30 moves with the movement of the end plug 32.

In standard fashion, the tube 30 is received within a sleeve 38 having a plurality of slots or openings 40 in the walls thereof to allow the beverage or liquid 16 to pass from the filling tank 14 to the bottle 28 in a manner known in the art. A collar 42 is fixed to the snift block 20 by means of an appropriate O-ring seal 44 or the like. The collar 42 also securely receives and engages the sleeve 38, though it will be appreciated that the sleeve 38 and collar 42 could be formed as a single unitary piece. In either event, the purpose and function are the same.

A guide block 46 is attached to the vent tube 30 by means of a lock pin 48 or other appropriate means. A bore 50 is provided within the collar 42 to receive the guide block 36. It will be appreciated that the guideblock 46 is not cylindrical like the bore, and is therefore not congruent with the bore, but provides for a passage area between the interior of the sleeve 38 and the interior of the collar 42 for passage of beverage therethrough. A pair of ears 52 abut the collar 42 at the base of the bore 50 to limit travel of the guideblock 46 therewithin. In other words, the maximum upward travel of the guideblock 46, and hence the tube 30, is limited by the engagement of the pair of ears 52 abutting the inner rim of the collar 42.

A spring 54 is interposed between a top surface of the collar 42 and a bottom surface of the end plug 32 as shown. The spring 54, which is rather weak in nature, urges the counter pressure tube 30 upward, as is well known to those skilled in the art. Of course, the maximum travel of the tube 30 under the urging of the spring 54 is limited by the ears 52 discussed above.

A collar 56 is fixedly received upon the tube 30 near the lower end thereof. It will be appreciated from the drawing that the tube 30 is shown as being of two part construction, with the collar 56 being engaged at the point of interconnection between the upper and lower portions of the tube 30. It will, of course, be appreciated by those skilled in the art that the tube 30 could indeed be a single integral tube if desired. In any event, an annular seal ring 58 is received within an annular groove about the collar 56. As is known to those skilled in the art, an angled or tapered bottom surface of the annular seal ring 58 is adapted to engage with a valve seat 60 provided at the top of the bore 24 in the snift block 20. The sealing engagement between the annular ring 58 and valve seat 60 is typically under control of a valve lever arm of the bottle filling device and is engaged to make a positive seal between the interior of the filling tank 14 and the exterior in communication with the bore 24.

A choke valve 62 is provided in the general configuration of a dome-shaped housing, having a plurality of openings 64 passing therethrough to provide a passageway for beverage as has previously been known in the art. A spring 66 is interposed between the collar 56 and the choke valve 62 to urge the two apart such that a valve seat 68 positioned about a lower circumferential perimeter thereof, is maintained in juxtaposition to the annular seal ring 58.

Figure 2:
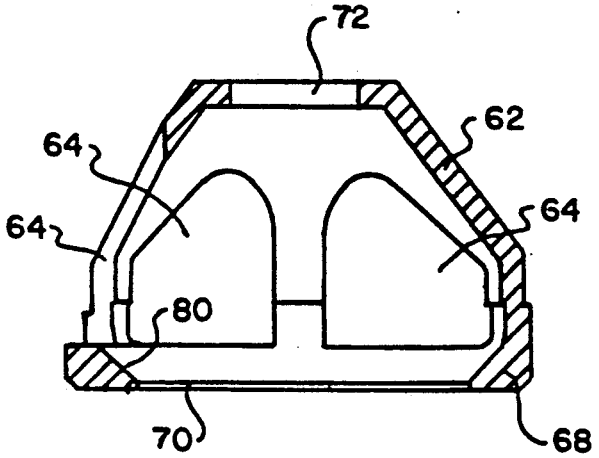
FIG. 2 is a cross sectional view of the choke valve of the invention.

As shown in FIG. 2, the dome-shaped choke valve 62 with the openings 64 passing therethrough is provided with a valve seat 68 about the lower perimeter thereof. An inner circumferential area 70 of the valve seat 68 is provided as being circular in nature. In the preferred embodiment of the invention, the area 70 is actually a cylindrical wall having an axis which is coextensive with the axis of the housing of the valve 62 and, accordingly, also coextensive with the axis of the tube 30. As shown, a bore 72 is provided to receive the tube 30 in standard fashion.

Figure 3:
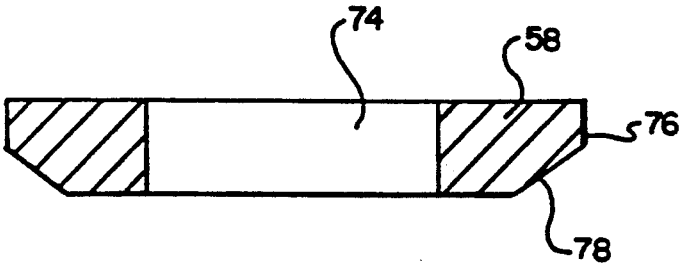
FIG. 3 is a cross sectional view of the disc of the liquid filling valve of the invention, the same being adapted for operational engagement with the valve of FIG. 2.

With reference to FIG. 3, it can be seen that the annular seal ring 58 is provided with a bore 74 to receive the tube 30 such that the annular seal ring 58 has an axis coextensive with the axis of the tube 30. The seal ring 58 is also provided with an external cylindrical surface 76 which is coaxial with the ring 58 and tube 30. Finally, an angled or tapered bottom surface 78 is provided for sealing engagement with the valve seat 68. The taper of the surface 78, from the flat bottom surface of the ring 58 is on the order of 30°–40° upwardly, and preferably at an angle of 35°. It will similarly be noted from reference to FIG. 2 that a downwardly tapered surface 80 extends downwardly to the cylindrical wall 70, making an angle of 45°–50°, preferably 42°, with such wall 70.

According to the invention, and to obtain the benefits thereof, it is desired that the annular seal ring 58 be received within, but not engage, the cylindrical wall 70 of the valve seat 68 of the choke valve 62. To that end, it is required that the outside diameter of the seal ring 58 be less than the inside diameter of the valve seat 68 as measured across the inner cylindrical wall 70. It is preferred that the difference in diameter between the ring 58 and valve seat 68 be on the order of 0.03–0.05 inch. In a preferred embodiment of the invention, the diameter of the cylindrical wall 70 would be on the order of 0.878–0.882 inch, with the outside diameter of the seal ring 58 would be on the order of 0.84–0.845 inch.

It is further most desired that the cylindrical surface 76 about the outside circumference of the seal 58 have a wall height substantially greater than the wall height of the cylindrical wall 70 of the valve seat 68. In a preferred embodiment of the invention, the wall 70 would have a height on the order of 0.008–0.02 inch, and preferably 0.01–0.015 inch, while the surface 76 would have a height on the order of 0.063–0.065 inch. Of course, the measurements of the wall heights just given are taken in the direction of the axis of the seal 58 and the choke valve 62.

With further reference to FIG. 1, it can be seen that each of the filling heads 12 also includes a charging valve 82 at the top end of the vent tube 30. A spring 84 encircles the tube 30 to urge the charging valve 82 open to allow the gas of the pressure head 18 to communicate with the interior of the tube 30 and into the interior of the bottle 28. A cap 86 is provided for engagement with a lever arm of the filling machine, as is known to those skilled in the art, to close the charging valve 82 and/or to move the tube 30 downwardly to seal the annular ring 58 against the valve seat 60. One or more apertures or openings 88 are provided at the bottom end of the tube 30, such orifices being positioned at a level on the tube 30 to correspond with the filled beverage level 90 in the bottle 28 at the end of the dispensing cycle. Again, such structure and operation is known to those skilled in the art.

With continued reference to FIG. 1, an appreciation of the operation of the instant invention can be attained. With a bottle 28, placed in engagement with the resilient seal 22, the lever arm of the filling machine releases the cap 86. At that time, the spring 54 urges the end plug 32 and tube 30 upwardly until the ears 52 of the guide block 46 are stopped against the collar 42. At the same time, the spring 84 urges the charging valve 82 open, allowing the carbon dioxide pressure head 18 to communicate through the tube 30 to pressurize the interior of the bottle 28. This equalization of pressure between the pressure head 18 and the interior of the bottle 28 allows disengagment of the seal 58 from the seat 60 and the lifting of the tube 30 as just described.

As beverage 16 begins to flow from the reservoir through the slots 40 and over the choke valve 62, the choke valve 62 is urged downwardly on the tube 30, compressing the spring 66, and placing the cylindrical wall 70 beneath the cylindrical wall 76. Accordingly, the flow path for beverage is provided between the top tapered surface 80 of the choke valve 62, and the bottom tapered surface 78 of the annular ring 58. With the choke valve 62 bottoming on the top of the snift block 20, the flow is somewhat laminar, absent the turbulence previously experienced in the art. It will be appreciated that the surface 80 directs the beverage 16 inwardly against the tapered surface 78 which then directs it downwardly. With the tapered surfaces both being generally in a downward direction, and at closely similar angles, turbulence is again minimized.

As will be understood by those skilled in the art, the flow just described continues into the bottle 28, with the gas therein being vented through the openings 88 back to the pressure head 18 until such time as the openings 88 are sealed by the beverage 16 reaching the level 90. At such point in time, beverage flow ceases such that the spring 66 urges the choke valve 62 upwardly, as previously known in the art, until the cylindrical surface 76 is received within the cylindrical surface 70, with the same sharing common planes normal to there common axis. At such time, a seal is generated preventing any further flow of beverage from the bore 24 into the bottle 28, and further preventing any escape of gas from the bottle 28 upwardly through the bore 24. Subsequently, the lever arm of the filling machine engages the cap 86 to press the tube 30 downwardly so that the tapered surface 78 of the seal ring 58 engages the seat 60 of the bore 24. At such time, the bottle 28 can be removed, capped, and cased. The process may then begin anew.

It will be readily appreciated that the seal 58, being of smaller diameter than the seat 68, and being coaxial therewith, is intended to be received within the seat 68 without contacting the same. The termination of flow by the choke valve 62 is thus achieved by molecular interaction at the close tolerance clearance between the elements 58, 68, and by surface tension thereat. Since the elements 58, 68 do not contact each other, or have very minimal contact, there is little likelihood that the two elements will stick together when opening of the same is desired upon the next dispensing cycle. Additionally, the configuration of the elements 58, 68 provides for a nonturbulent flow of the beverage during the dispensing cycle, while the noncontacting valve seat arrangement provides for a nonturbulent closure of the valve. The absence of turbulence reduces the amount of foam experienced in dispensing carbonated beverages, allowing for more accurate and rapid filling.

Those skilled in the art will readily appreciate that the improved choke valve presented herein can be employed equally well with both pressurized and unpressurized tanks and containers. While pressurized tanks are most desired for carbonated beverages and the like, non carbonated beverages and liquids may be dispensed at atmospheric pressure under the force of gravity. In the pressurized system presented above, the lever arm of the filling machine commences the valving operation which is completed by spring force upon equalization of pressure between the tank and bottle. In an unpressurized system according to the invention, the valve is positively and directly opened by the filling machine lever arm.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A bottle filling apparatus, comprising:

a filling tank for receiving liquid therein;

a seal in a base portion of said tank for sealingly securing a mouth of a bottle;

a vent tube extending within said tank at a first end thereof to an interior of said bottle at a second end thereof, said tube having respective first and second apertures at said first and second ends;

a sleeve receiving said tube, said sleeve receiving liquid from said filling tank and seving as a conduit for passing said liquid from said tank to said bottle; and a choke valve interposed between said sleeve and said bottle for selectively inhibiting and enabling said passing of liquid, said choke valve comprising an inner ring and an outer ring, said inner ring being received within said outer ring, said inner and outer rings being out of contact with each other both when said valve is open and when said valve is closed.

2. The bottle filling apparatus according to claim 1, wherein said inner and outer rings are axially moveable along a common axis independent of each other.

3. The bottle filling apparatus according to claim 2, wherein said inner ring has a cylindrical outer wall surface, and said outer ring has a cylindrical inner wall surface, said cylindrical surfaces sharing a common axis.

4. The bottle filling apparatus according to claim 3, wherein said inner ring has a lower surface angled inwardly toward said common axis from a bottom edge of said cylindrical outer wall surface, and said outer ring has an upper surface angling outwardly away from said common axis from a top edge of said cylindrical inner wall surface.

5. The bottle filling apparatus according to claim 4, wherein each of said upper and lower surfaces forms a different angle with said common axis.

6. The bottle filling apparatus according to claim 4, wherein a difference in diameter between said cylindrical inner and outer wall surfaces is between 0.03 and 0.05 inch.

7. The bottle filling apparatus according to claim 4, wherein said outer cylindrical wall has height greater than a height of said inner cylindrical wall.

8. The bottle filling apparatus according to claim 7, wherein said inner cylindrical wall has a height of between 0.008 and 0.02 inches.

9. The bottle filling apparatus according to claim 4 wherein said inner ring is fixedly attached to said vent tube and said outer ring is slidingly received upon said vent tube.

10. In a bottle filling apparatus having a tank for receiving liquid therein, a seal in a base portion of the tank for receiving a mouth of a bottle, a tube within the tank extending from the tank at one end to the bottle at the other end, the tube having openings at each of the two ends, and a sleeve receiving the tube and serving as a conduit for passing liquid from the tank to the bottle, the improvement of a choke valve interposed between the sleeve and the bottle for selectively inhibiting and enabling said passing of liquid from the tank to the bottle, said choke valve comprising:

a disc fixedly received upon said tube and concentric with said tube; and a cylindrical seat received upon and concentric with said tube, said seat adapted to receive said disc within said seat.

11. The improvement in a bottle filling apparatus according to claim 10, wherein said disc has a cylindrical external surface, said cylindrical external surface of said disc having a diameter less than a diameter of said cylindrical seat.

12. The improvement in a bottle filling apparatus according to claim 11, wherein said cylindrical seat is axially moveable upon said tube.

13. The improvement is a bottle filling apparatus according to claim 12, wherein said cylindrical seat has a height less than a height of said cylindrical external surface.

14. The improvement in a bottle filling apparatus according to claim 13 wherein said choke valve further comprises a first surface angling upwardly from a top edge of said cylindrical seat away from a common axis of said tube and a second surface angling downwardly from a bottom edge of said cylindrical external surface of said disc toward said common axis.

15. The improvement in a bottle filling apparatus according to claim 14, further comprising a spring interposed between said disc and said cylindrical seat.

* * * * *